US009474669B1

(12) United States Patent
Bush et al.

(10) Patent No.: US 9,474,669 B1
(45) Date of Patent: Oct. 25, 2016

(54) MULTIPURPOSE POSITIONING DEVICE FOR INFANTS

(71) Applicant: Tarry Medical Products, Inc., Danbury, CT (US)

(72) Inventors: Cathy Bush, Plymouth, MA (US); Scott Bell, Danbury, CT (US); Lou Casella, Far Hills, NJ (US); John Chappel, Basking Ridge, NJ (US); Sandy Conner, Kirkwood, MO (US); George Quattropani, Bronxville, NY (US); Mary Raney, Edwardsville, IL (US); Chrysty Sturdivant, Dallas, TX (US)

(73) Assignee: TARRY MEDICAL PRODUCTS, INC., Danbury, CT (US)

( * ) Notice: Subject to any disclaimer, the term of this patent is extended or adjusted under 35 U.S.C. 154(b) by 0 days.

(21) Appl. No.: 15/131,239

(22) Filed: Apr. 18, 2016

Related U.S. Application Data

(63) Continuation of application No. 12/878,400, filed on Sep. 9, 2010, now Pat. No. 9,332,791.

(60) Provisional application No. 61/241,533, filed on Sep. 11, 2009.

(51) Int. Cl.
*A41D 11/00* (2006.01)
*A61G 11/00* (2006.01)
*A47D 15/00* (2006.01)

(52) U.S. Cl.
CPC ..... *A61G 11/00* (2013.01); *A47D 15/008* (2013.01)

(58) Field of Classification Search
CPC ..... A41D 11/00
USPC ..... 5/655, 424, 631–633, 494, 496
See application file for complete search history.

(56) References Cited

U.S. PATENT DOCUMENTS

| | | | | |
|---|---|---|---|---|
| 3,289,224 | A | 12/1966 | Witchel | |
| 3,739,399 | A * | 6/1973 | Sheahon | A41B 13/06 2/69.5 |
| 3,813,148 | A | 5/1974 | Kraus | |
| 4,333,591 | A | 6/1982 | Case | |
| D269,475 | S | 6/1983 | Albertson | |
| 4,611,353 | A | 9/1986 | Als et al. | |
| 4,648,142 | A | 3/1987 | Bruning | |
| 4,783,865 | A | 11/1988 | Stotler | |
| 5,014,376 | A | 5/1991 | Doran et al. | |
| 5,046,204 | A | 9/1991 | Mohler | |
| 5,148,564 | A | 9/1992 | Reder | |
| 5,182,828 | A | 2/1993 | Alivizatos | |

(Continued)

*Primary Examiner* — Fredrick Conley

(74) *Attorney, Agent, or Firm* — DeLio, Peterson & Curcio, LLC; Kelly M. Nowak

(57) ABSTRACT

A multipurpose infant positioning device that includes a lower pad with front and back surfaces, wings attached to lateral sides of the lower pad and a bottom flap attached to the bottom portion of the lower pad. At least one of the wings and bottom flap have fastening segments attached thereto for adjustably attaching these components to portions of the lower pad. The fastened wing and bottom flap are made of a material having sufficient resiliency to maintain and bring an infant back to flexed midline position within the infant positioning device. These infant positioning devices may further include a headpiece, brim, pocket at the back surface of the lower pad and a detachable readjustable multipurpose pillow for positioning the infant from and between supine, prone and side-lying positions, all while maintaining and reinforcing the flexed midline position of the infant for normal development.

20 Claims, 10 Drawing Sheets

(56) References Cited

U.S. PATENT DOCUMENTS

| | | | | |
|---|---|---|---|---|
| 5,193,238 | A | 3/1993 | Clute | |
| 5,261,133 | A | 11/1993 | Wilkerson | |
| 5,341,531 | A | 8/1994 | Straub et al. | |
| 5,371,909 | A | 12/1994 | McCarty | |
| 5,439,008 | A | 8/1995 | Bowman | |
| 5,524,640 | A | 6/1996 | Lisak et al. | |
| 5,546,620 | A | 8/1996 | Matthews | |
| 5,581,833 | A | 12/1996 | Zenoff | |
| 5,632,052 | A | 5/1997 | Michel | |
| 5,937,461 | A | 8/1999 | Dombrowski et al. | |
| 6,006,381 | A | 12/1999 | Tandrup | |
| 6,036,263 | A * | 3/2000 | Gold | A47D 1/008 297/219.12 |
| 6,052,849 | A | 4/2000 | Dixon et al. | |
| 6,055,686 | A | 5/2000 | Knight | |
| 6,082,683 | A | 7/2000 | Yates | |
| 6,088,854 | A | 7/2000 | Brownrigg | |
| 6,161,239 | A | 12/2000 | Grazel | |
| D440,805 | S | 4/2001 | Rogone et al. | |
| 6,269,502 | B1 | 8/2001 | Exstrom | |
| 6,292,964 | B1 | 9/2001 | Rose et al. | |
| D450,516 | S | 11/2001 | Darling et al. | |
| D450,517 | S | 11/2001 | Darling et al. | |
| 6,360,388 | B2 | 3/2002 | Langer | |
| 6,381,785 | B1 | 5/2002 | Mancera Browne et al. | |
| 6,381,787 | B1 | 5/2002 | Rogone et al. | |
| 6,473,923 | B1 | 11/2002 | Straub | |
| 6,481,032 | B2 | 11/2002 | Milano et al. | |
| 6,585,672 | B1 | 7/2003 | Crompton | |
| 6,594,829 | B1 | 7/2003 | Turkheimer | |
| 6,658,681 | B2 | 12/2003 | Britto et al. | |
| 6,810,545 | B1 | 11/2004 | Darling et al. | |
| 6,839,924 | B2 | 1/2005 | Sims | |
| 6,868,566 | B2 | 3/2005 | Gatten | |
| 6,872,220 | B2 | 3/2005 | Williams et al. | |
| 6,877,176 | B2 | 4/2005 | Houghteling | |
| 6,912,743 | B1 | 7/2005 | Weil | |
| 6,954,954 | B2 | 10/2005 | Stelnicki | |
| 6,966,089 | B2 | 11/2005 | Gold et al. | |
| 7,003,831 | B1 | 2/2006 | Goutevenier-Reyher | |
| 7,007,323 | B2 | 3/2006 | Zerhusen et al. | |
| 7,107,639 | B2 | 9/2006 | Taricani | |
| 7,111,344 | B2 | 9/2006 | French | |
| 7,117,553 | B2 | 10/2006 | Fairchild et al. | |
| 7,185,378 | B2 | 3/2007 | Smith | |
| D541,506 | S | 5/2007 | Heiman-Philpott | |
| 7,225,485 | B2 | 6/2007 | Binder | |
| 7,353,552 | B2 | 4/2008 | Leach | |
| 2004/0195880 | A1 | 10/2004 | Gardner et al. | |
| 2007/0157392 | A1 | 7/2007 | Ragen | |

* cited by examiner

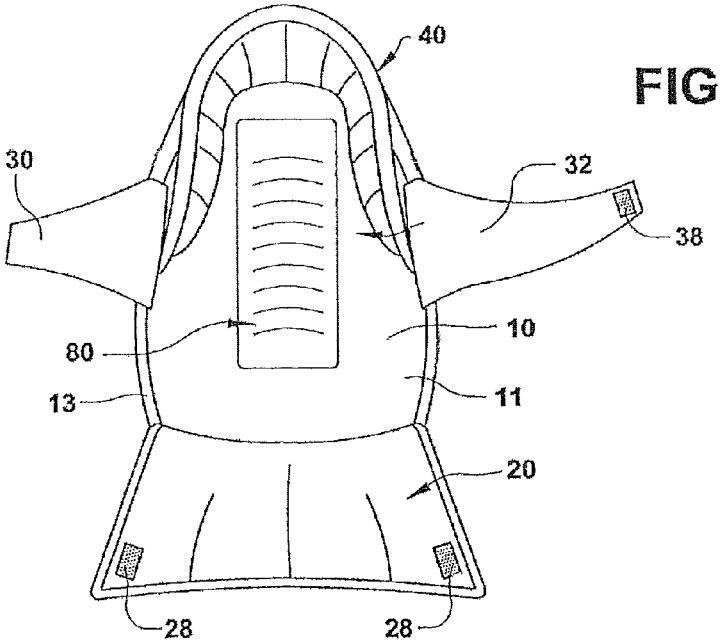
FIG. 7C
FIG.7D
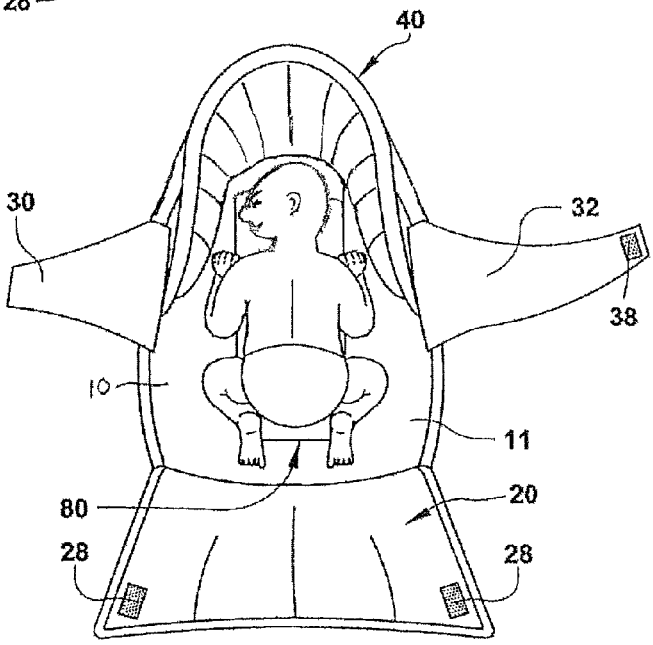

MULTIPURPOSE POSITIONING DEVICE FOR INFANTS

PRIORITY

This application claims priority to U.S. Non-Provisional application Ser. No. 12/878,400 filed on Sep. 9, 2010 which claims the benefit of U.S. Provisional Application Ser. No. 61/241,533 filed Sep. 11, 2009, which are hereby incorporated by reference in their entireties.

BACKGROUND OF THE INVENTION

1. Field of the Invention

The present invention relates generally to a multipurpose infant positioning device.

2. Description of Related Art

Preterm infants are born before optimal fetal musculoskeletal and neurologic maturation has completed, and as such, are initially cared for in a neonatal intensive care unit (NICU). Ill infants are also typically cared for in the NICU. Since the womb inherently provides dynamic boundaries for the infant, one of the goals in the NICU is to simulate a womb-like environment for facilitating continued development of the preterm and/or ill infant.

In normal fetal development the uterine boundaries counterbalance the forceful prenatal motor pattern of active extensions forcing the fetus back to a flexed midline position, which is important for development. This flexed midline position is also important for the continued development of preterm and/or ill infants. Since inadequate positioning can result in a variety of issues profoundly impacting the infant's early development, it is important to provide infants with proper postnatal positioning.

Proper infant positioning promotes neurobehavioral organization, musculoskeletal development and neuromotor functioning. The four key concepts in proper therapeutic postnatal positioning are flexion, midline, containment and comfort. There are three typical techniques or orientations used in therapeutic positioning: 1) "supine" (i.e., infant on its back), 2) "prone" (i.e., infant on its belly), and 3) "side-lying" (i.e., infant on one of its sides.) Each has their own medical and developmental advantages. Infants are repositioned frequently, typically every two to four hours or when behavior cues suggest discomfort. Additionally, access to the infant is needed for diapering and maintenance of medical connections such as feeding tubes and ventilator ports. Repositioning and access to the infant should be done with minimal disruption to the infant.

Several types of external supports and devices exist for postnatal therapeutic positioning to compensate for the infant's immature motor control and the lack of the natural boundary of the womb. Often, comfortable boundaries are established to contain the preterm and/or ill infant in a position of gentle flexion and midline orientation of the extremities with the head and trunk supported in neutral alignment with the body. For instance, blankets, towels, bedding and diapers are often used as makeshift devices to support the infant and define these boundaries. These items are typically rolled whereby several are utilized in cooperation to establish and define boundaries. However, these conventional items and approaches suffer from the limitation that they have the tendency to unroll, loosen and/or shift away from their position against the infant, and as such, do not provide secure boundaries that maintain the infant in a desired position for prolonged periods.

Commercial products are also available for facilitating infant positioning to contain preterm and/or ill infants. However, many of these devices suffer from the limitation that they only provide a boundary on a limited portion of the periphery around the infant, whereby these boundaries are limited in restraining the infant within the device. Current commercially available devices are also limited in the therapeutic position that each one supports.

U.S. Pat. No. 4,611,353 discloses an infant garment sack that includes a closed sack portion with a hood and two elongated flaps that each wrap entirely around the infant and meet at the back of the sack. The closed sack portion has an elastic band at a top portion thereof for gathering in the top of the sack around the infant and a cylindrical section of thick, resilient material at the bottom thereof for enabling the infant to dig its toes therein. While this device has a sack portion and flaps, the sack is limited in that the elastic band does not fit securely around all sized infants nor does the sack enable one to gain access to the infant therein (e.g., for repositioning, changing, etc.) without disturbing the infant. Additionally, the flaps have a consistent width over the length thereof, such that, the flaps must be wrapped offset around the infants arms. As the infant's arms move the offset flaps do not provide an adequate boundary that bring back the infant's arms to the desired flexion and midline infant positioning. Another drawback of this infant garment sack is that it is restricted to placing the infant in the supine position (i.e., on its back).

Other commercially available devices are the SnuggleUp®, the Bendy® Bumper and the Cozycare™ Bunting, all of which are available from Children's Medical Ventures. The SnuggleUp® is limited in that it has a lower pad with double straps extending from a single side of the device, it has no boundary for the head, and it has a cushioned restraining footrest. The Bendy® Bumper, while able to be formed to provide a boundary around the periphery of an infant, is not in and of itself able to provide the desirable flexion in the infant. Also, bunting type devices (e.g., the Cozycare™ Bunting) are currently available that are typically composed of a single piece of material that wraps around the infant for containment. Yet, none of these commercially available products support the flexion and midline positioning techniques, which are essential for normal fetal development, for extended periods, nor adequately enough to provide the infant with sufficient support that is required for normal development. The commercially available devices also are limited in the positions they support. For instance, the Prone Plus™ is designed specifically for use in assisting proper prone positioning of an infant. Positioning in multiple orientations would require multiple devices.

SUMMARY OF THE INVENTION

Bearing in mind the problems and deficiencies of the prior art, it is therefore an object of the present invention to provide a multipurpose infant positioning device that is interchangeable and adjustable to support various therapeutic infant positioning techniques.

It is another object of the present invention to provide a multipurpose infant positioning device that provides an infant with freedom of movement in order to achieve and support normal tonic and postural balance.

Another object of the invention is to provide a multipurpose infant positioning device for positioning an infant therein in the supine position.

It is a further object of the present invention to provide a multipurpose infant positioning device for positioning an infant therein in the side-lying position.

It is yet another object of the present invention to provide a multipurpose infant positioning device for positioning an infant therein in the prone position.

It is a further object of the present invention to provide an infant positioning device in which an infant may be repositioned between any two of the supine, side-lying and prone positions without removing the infant from the device and without substantially disturbing the infant.

Still other objects and advantages of the invention will in part be obvious and will in part be apparent from the specification.

The above and other objects, which will be apparent to those skilled in the art, are achieved in the present invention which is directed to an infant positioning aid including a lower pad, a wing at a lateral side of the lower pad, a fastener attached to the wing to attach the wing to a plurality of different locations on the lower pad, and a bottom flap of the lower pad. The wing has a length long enough to extend across a width of the lower pad and has resiliency along this length, while the bottom flap has a fastening segment to securely attach the bottom flap to different locations on the lower pad.

The plurality of different attaching locations may reside on a back surface, a front surface and a side of the lower pad. The infant positioning aid may further include a second wing and/or a headpiece attached to a top portion of the lower pad. Attached to the headpiece may also be a brim, and one or more fastening components attached to the headpiece to fold and secure the headpiece down to a retracted position. The one or more fastening components may comprise a first component of a hook and loop mating connection, while the outer surface of the headpiece comprises a material that acts as the second component of the hook and loop mating connection. In particular, the fastening components may be the hook component while the material of the headpiece is the loop component, or vice versa.

The infant positioning aid may further include a detachable multipurpose pillow that is adjustably positioned to a number of locations on the infant positioning device to support an infant therein in different therapeutic infant positions. These positions may include the detachable multipurpose pillow residing adjacent the infant's hips and pelvis to support the infant in a supine position, or residing adjacent the infant's back to support the infant in a side-lying position, or even, residing under the infant's belly to support the infant in a prone position.

The positioning aid may also include a pocket attached to the back surface of the lower pad, and a detachable multipurpose pillow residing within the pocket to support an infant in a prone position. The front surface of the lower pad is preferably of a material that will not harm an infant's skin. This material may be an organic cotton material.

The fastener that is attached to the wing may be a first component of a hook and loop mating connection while portions of the lower pad comprise a material that acts as the second component of the hook and loop mating connection. For instance, the fastener may be the hook component while the material of the back surface is the loop component, or the fastener may be the loop component while the material of the back surface is the hook component.

In one or more embodiments, the bottom flap may be a material that allows stretching of the bottom flap in a direction that is at least parallel with the length of the lower pad to allow an infant to flex and return to a midline position. The fastening segment of the bottom flap may be a first component of a hook and loop mating connection while portions of the lower pad may be a material that acts as the second component of the hook and loop mating connection. Also, the bottom flap may further include seams that provide channels therein for receiving and maintaining an infant's feet and legs in a flexion midline position. In the invention, the bottom flap, with its two fastening segments, allows easy access to an infant residing within the infant positioning device with minimal disturbance of the infant.

In other embodiments, the invention is also directed to a multipurpose infant positioning device that includes a lower pad; a wing attached to a lateral side of the lower pad, the wing having a length long enough to extend across a width of the lower pad and having resiliency along said length; a fastener attached to the wing to attach the wing to a plurality of different locations on the lower pad; a bottom flap attached to the lower pad, the bottom flap having a fastening segment to securely attach the bottom flap to the plurality of different locations on the lower pad; a headpiece attached to the lower pad; and a detachable pillow having a fastener attached thereto to adjustably attach the detachable pillow to the plurality of different locations on the lower pad.

In these embodiments the device may further include a second wing, of equal or unequal lengths to the first wing, a brim attached to the headpiece, or even one or more fastening components attached to an outer surface of the headpiece to fold the headpiece down to a retracted position. The one or more fastening components may be a first component of a hook and loop mating connection while the outer surface of the headpiece may be a material that acts as the second component of the hook and loop mating connection. The wing may be an interlock weave material to provide the wing with resiliency along its length.

Further in these embodiments, the detachable pillow may reside adjacent the infant's hips and pelvis to support the infant in a supine position, or it may reside adjacent the infant's back to support the infant in a side-lying position, or it may reside under the infant's belly to support the infant in a prone position. These embodiments may further include a pocket attached to the back surface of the lower pad, whereby the detachable pillow resides within the pocket to support an infant in a prone position. The front surface of the lower pad may be of a material that will not harm an infant's skin, such as, an organic cotton material.

In these embodiments, the fastener attached to the wing also may be a first component of a hook and loop mating connection, while portions of the lower pad are a material that acts as the second component of the hook and loop mating connection. The bottom flap may be a material that allows stretching of the bottom flap in a direction that is at least parallel with the length of the lower pad to allow an infant to flex and return to a midline position. Further, the fastening segment of the bottom flap may be a first component of a hook and loop mating connection while portions of the lower pad are a material that acts as the second component of the hook and loop mating connection. The bottom flap may further include seams that provide channels therein for receiving and maintaining an infant's feet and legs in a flexion midline position. Again, this bottom flap, with its fastening segment allows, easy access to an infant residing within the infant positioning device with minimal disturbance of the infant.

In still other embodiments, the invention is directed to an infant positioning device that includes a lower pad; at least one wing attached to a lateral side of the lower pad having a length long enough to extend across a width of the lower pad and having resiliency along said length; and a fastener attached to the wing to adjustably attach the wing to a plurality of different locations on the lower pad. In these embodiments, the wing may be attached to the plurality of different locations residing on a back surface, a front surface and a side of the lower pad, and the wing may be composed of an interlock weave material to provide the wing with resiliency along its length.

In further embodiments the invention is directed to an infant positioning device that includes a lower pad; a pair of wings attached to opposing lateral sides of the lower pad, whereby one of the wings has a length long enough to extend across a width of the lower pad and has a fastener attached thereto to adjustably attach the wing to a plurality of different locations on the lower pad. The pair of wings may have equal or unequal lengths. The attached wing may be attached to the plurality of different locations residing on a back surface, a front surface and a side of the lower pad.

The invention is directed to in other embodiments an infant positioning device that includes a lower pad; and a bottom flap of the lower pad, the bottom flap having a fastener attached thereto to adjustably attach the bottom flap to a plurality of different locations on the lower pad.

The invention is also directed to an infant positioning device that includes a lower pad; and a detachable pillow having a fastener attached thereto to adjustably attach the detachable pillow to a plurality of different locations on the lower pad. These embodiments may further include a pocket on a back surface of the lower pad, the detachable pillow residing within the pocket. The detachable pillow may be attached to the plurality of different locations residing on a back surface, a front surface and a side of the lower pad.

The invention is further directed to an infant positioning device that includes a lower pad; and a headpiece attached to the lower pad, the headpiece having at least one fastener attached thereto to adjust the headpiece to a retracted position.

The invention is still further directed to an infant positioning device that includes a lower pad; a headpiece attached to the lower pad; and a detachable brim having at least one fastener attached thereto to adjustably attach the detachable brim to a plurality of different locations on the headpiece.

In other embodiments, the invention is directed to methods of therapeutically positioning an infant by providing an infant positioning device adaptable to support an infant in a variety of different therapeutic infant positions, the infant positioning device at least including a lower pad, a first wing attached to the lower pad with a length long enough to extend across a width of the lower pad and having resiliency along said length, and a fastener attached to the first wing to adjustably attach the first wing to a plurality of different locations on the lower pad; positioning an infant on the lower pad of the infant positioning device; wrapping the first wing over the infant; and attaching the first wing to one of the plurality of different locations on the lower pad.

In these embodiments, the first wing may be attached to a back surface, a front surface or a side of the lower pad. These methods may further include the infant positioning device having a second wing, whereby the second wing is wrapped around the infant followed by attaching the first wing over the infant to maintain the infant in a flexed midline position.

Other embodiments of the invention are directed to methods of therapeutically positioning an infant by providing an infant positioning device adaptable to support an infant in a variety of different therapeutic infant positions, the infant positioning device at least including a lower pad, a first wing attached to the lower pad with a length long enough to extend across a width of the lower pad and having resiliency along said length, and a fastener attached to the first wing to adjustably attach the first wing to a plurality of different locations on the lower pad; positioning an infant on the lower pad of the infant positioning device in a desired therapeutic infant position; wrapping the first wing over the infant; and attaching the first wing to one of the plurality of different locations on the lower pad to maintain the infant in the desired therapeutic infant position.

In these methods the first wing may be attached to a back surface, a front surface or a side of the lower pad. The desired therapeutic infant position may be selected from the group consisting of supine, prone and side-lying. The infant positioning device may have a second wing, whereby the second wing is wrapped around the infant followed by attaching the first wing over the infant to maintain the infant in a flexed midline position. The infant positioning device may have a bottom flap attached to the lower pad, and further including pulling the bottom flap over the infant's lower extremities and securely attaching a fastening segment of the bottom flap to one of the plurality of different locations on the lower pad. Also, the infant positioning device may have a detachable pillow, and further including adjustably attaching the detachable pillow to one of the plurality of different locations on the lower pad.

In these methods, a pocket may reside on a back surface of the lower pad, whereby the detachable pillow resides within the pocket. The detachable pillow may reside adjacent the infant's back to support the infant in a side-lying position, or it may reside under the infant's belly to support the infant in a prone position, or it may reside adjacent the infant's hips and pelvis to support the infant in a supine position. The infant positioning device may have a headpiece attached to the lower pad, the headpiece having at least one fastener attached thereto.

These methods may further include attaching the at least one fastener to an outer surface of the headpiece to lowering the headpiece to a retracted position, or attaching a brim to the headpiece.

Still other embodiments of the invention are directed to methods of therapeutically positioning an infant by providing an infant positioning device adaptable to support an infant in a variety of different therapeutic infant positions, the infant positioning device at least including a lower pad and a detachable pillow; providing the detachable pillow in contact with the lower pad of the infant positioning device to support a desired therapeutic infant position; and positioning an infant on the lower pad of the infant positioning device whereby the detachable pillow supports the infant in the desired therapeutic infant position.

In these embodiments, the detachable pillow also may reside adjacent the infant's back to support the infant in a side-lying position, or it may reside under the infant's belly to support the infant in a prone position, or it may reside adjacent the infant's hips and pelvis to support the infant in a supine position. A pocket may be attached to a back surface of the lower pad, wherein the detachable pillow resides within the pocket to support the infant in a prone position. The desired therapeutic infant position may be supine, prone or side-lying positions. The method may also include the step of repositioning the infant from the desired therapeutic infant position to another desired therapeutic infant position selected from the group consisting of supine, prone and side-lying positions without removing the infant from the infant positioning device and without substantially disturbing the infant.

In one or more embodiments the invention is directed to methods of therapeutically positioning an infant by providing an infant positioning device adaptable to support an infant in a variety of different therapeutic infant positions, the infant positioning device at least including a lower pad, first and second wings attached to the lower pad, a bottom flap attached to a bottom portion of the lower pad, and a detachable multipurpose pillow; positioning an infant on the lower pad of the infant positioning device; positioning the detachable pillow in a location on the infant positioning device that supports a desired therapeutic infant position; wrapping at least the second wing over the infant; securely and adjustably attaching the second wing to one of a plurality of different locations on the infant positioning device; and pulling the bottom flap over the infant's lower extremities and securely attaching a fastening segment of the bottom flap to one of the plurality of different locations on the infant positioning device.

When the desired therapeutic infant position is a supine position, these methods may further include the steps of positioning the infant on its back on the lower pad of the infant positioning device; wrapping the first and second wings over the infant's arms to maintain the infant in a flexed midline position; positioning the detachable multipurpose pillow under the infant's pelvis to round out the infant's hips, legs and feet to the flexed midline position; and pulling the bottom flap over the infant's lower extremities and securely attaching the fastening segment of the bottom flap to the one of the plurality of different locations on the infant positioning device to maintain the flexed midline position.

When the desired therapeutic infant position is a side-lying position, these methods may further include the steps of providing the infant on its side on the lower pad of the infant positioning device; positioning the infant in a flexed midline position while in the side-lying positioning; positioning the detachable multipurpose pillow against the back of the side-lying infant to maintain the flexed midline position; wrapping at least the second wing over the infant's anus and attaching the second wing to the one of the plurality of different locations on the infant positioning device; and pulling the bottom flap over the infant's lower extremities and securely attaching the fastening segment of the bottom flap to the one of the plurality of different locations on the infant positioning device to maintain the flexed midline position.

When the desired therapeutic infant position is a prone position, these methods may further include the steps of inserting the detachable pillow inside a pocket residing on the back surface of the infant positioning device to form a bump on a front surface of the lower pad; positioning the infant's belly over the bump on the front surface so that the infant's shoulders, arms, hips, knees, legs, and feet fall into a flexed midline position; wrapping at least the second wing over the infant and attaching the second wing to the one of the plurality of different locations on the infant positioning device; and pulling the bottom flap over the infant's lower extremities and securely attaching the fastening segment of the bottom flap to the one of the plurality of different locations on the infant positioning device to maintain the flexed midline position. A soft pillow may be provided over the bump on the front surface of the infant positioning device, whereby the infant contacts the soft pillow for added comfort.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

FIGS. 7A-D are top down views illustrating still another embodiment of implementing the present infant positioning device for positioning an infant therein in the prone position.

DESCRIPTION OF THE PREFERRED EMBODIMENT(S)

Figure 1A:
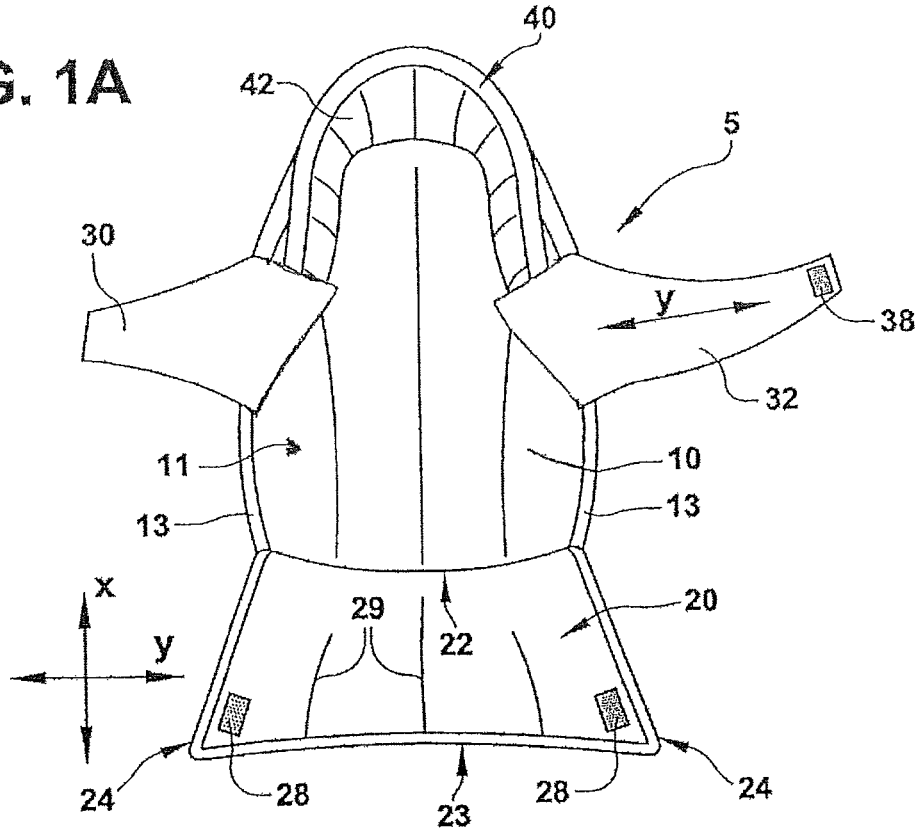
FIG. 1A is a top down, front side view of an infant positioning device in accordance with one or more embodiments of the present invention.

In describing the preferred embodiment of the present invention, reference will be made herein to FIGS. 1A-7D of the drawings in which like numerals refer to like features of the invention.

The present invention is directed to one or more embodiments of multipurpose infant positioning devices 5 that each enables an infant to be securely positioned and supported therein while providing the infant with freedom of movement. In one or more embodiments of the invention, the multipurpose infant positioning device 5 includes at least a lower padding 10, a bottom flap 20 and a pair of wings 30 and 32 on opposite sides of the lower padding 10. In other embodiments, the present multipurpose infant positioning devices include a lower padding 10, a bottom flap 20, a first wing 30, a second wing 32, a headpiece 40, a brim 50, and a multipurpose roll or pillow 60 (hereinafter referred to as "pillow 60"). These various embodiments of the invention are discussed in further detail below.

Referring to FIGS. 1A-D, in one or more preferred embodiments, the present multipurpose infant positioning device 5 includes a lower padding 10 with a front surface 11 and a back surface 12. The lower padding 10 is an elongated double layer of fabric filled with a thin layer of batting between the fabric layers to cushion this lower padding. The front surface 11 of the lower padding makes contact with the infant, and as such, is made of a material that will not harm or adversely affect the infant's skin. In a preferred embodiment, the fabric of the front surface 11 is preferably an organic cotton material. The back surface 12 of the lower padding 10 is securely sewn to the front surface 11. The back surface 12, or a device thereon (e.g., strip of Velcro®), acts as either a hook or loop mating segment for respective loop or hook mating segments attached to different components of the present multipurpose infant positioning devices for adjustably fastening these components at various locations on and across the infant positioning device 5 (as discussed further below).

In one or more embodiments, the back surface 12 may be composed of a material that acts as either a hook or loop mating segment for respective loop or hook mating segments that are attached to the different components of the present multipurpose infant positioning devices. In these embodiments, the fabric of the back surface 12 acts as the loop portion of a hook and loop mating connection (e.g., Velcro®), such as, a brushed or napped tricot polyester blend as a loop mating segment for securely receiving and holding hook mating segments attached to the present infant positioning device.

As an alternative embodiment, one or more pieces of a hook or loop mating connection may be attached to the back surface 12 of the lower padding 10. For instance, sections or strips of loop mating material 16 may be securely attached to the back surface 12 of the pad for enhancing connectivity between the back surface of the pad and the various hook mating segments of, or attached to, the infant positioning device. These strips of loop material 16 may also help to keep the infant positioning device 5 in a secure resting position on a resting surface having hook mating portions.

As still other embodiments, the lower padding 10 may be composed of a material that acts as either a hook or loop mating segment, particularly on a perimeter lateral surface 13 thereof or a portion of the front surface 11. In one or more embodiments the lower padding surfaces 13, 11 may have one or more devices thereon (e.g., one or more strips of Velcro®) that act as a hook or loop mating segment. In still other embodiments the lower padding surfaces 13, 11 may have combinations of both itself as the hook or loop mating segment in combination with sections or pieces of hook or loop material.

An essential feature of the multipurpose infant positioning devices 5 of the invention is that various components of such devices 5 are adjustably positionable, and/or repositionable once attached to the device 5, for attaching and securing these various components to a number of different locations on or across the infant positioning device itself. The components of the infant positioning device 5 that may be adjustably positionable and repositionable include the bottom flap 20, at least one (or both) wings 30 or 32, the multipurpose pillow 60 and the brim 50.

Figure 1B:
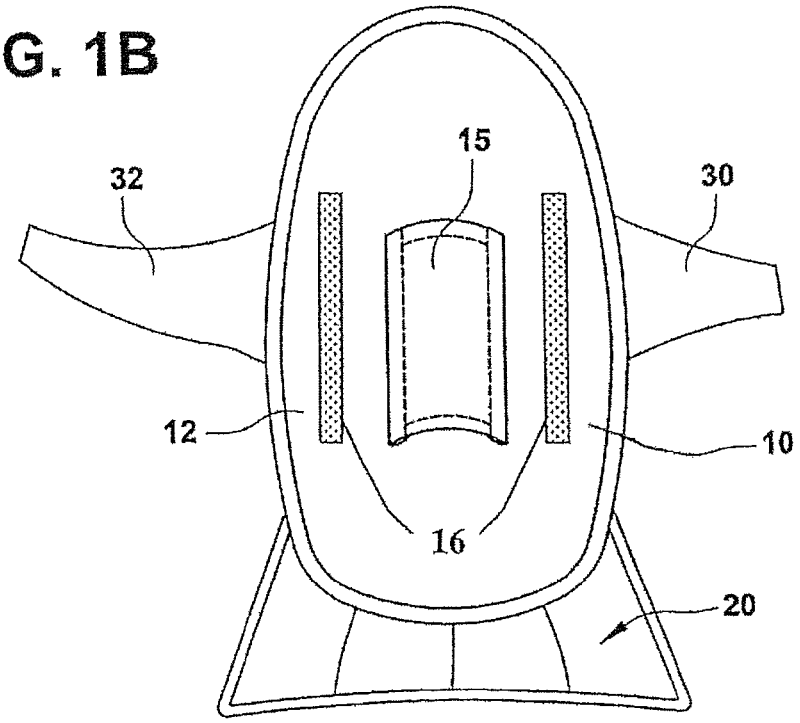
FIG. 1B is a top down, back side view of the infant positioning device of FIG. 1A.

The back surface 12 of the lower padding 10 may also be preferably provided with a pocket 15 as shown in FIG. 1B that is composed of the same or similar hook/loop mating fabric as the back surface 12. This pocket 15 is securely fastened (e.g., sewn) on both its sides corresponding to the length of the lower padding 10 and is open at its top and bottom sides, which correspond to the top and bottom portions of the lower padding 10. These open top and bottom sides of the pocket are adapted to receive the multipurpose pillow 60 therein for positioning an infant in the present positioning device 5 in the prone position, as discussed in more detail below. Alternatively, this pocket 15 may be securely fastened on any, or even all, of its sides so long as the pocket is provided with at least one opening for receiving and holding a multipurpose pillow 60 therein (as discussed further below). For instance, the pocket 15 may be securely fastened on three (3) sides, such that, one side of the pocket remains open for receiving the pillow 60, or even all sides of the pocket 15 may be fastened whereby the pocket is provided with an opening on its top surface for receiving the pillow 60. It should also be appreciated that while the pocket 15 is shown in the drawings as having a rectangular shape, this pocket may have any shape that corresponds to the shape of the multipurpose pillow 60 so that such pocket is able to receive and hold the multipurpose pillow therein.

A bottom flap 20 is attached to the front surface 11 of the lower padding 10. This bottom flap 20 is composed of a single or double ply unpadded fabric that is capable of significantly stretching in the x-direction but not significantly stretching in the y-direction, as shown in FIG. 1A. Such fabric is otherwise known in the art as an interlock weave or fabric woven on a bias, wherein the degree of stretching varies substantially by direction of the fabric weave. The bottom flap 20 is attached to the front surface of the lower padding in a manner that allows the bottom flap to be adjustably positionable and repositionable once attached to the device 5 so that it may be attached and secured to various locations on or across the infant positioning device 5 itself. That is, it is preferred that the bottom flap 20 be adjustable so that it securely holds and comforts an infant resting in the positioning device.

In one or more embodiments, the bottom portion 22 of the flap 20 is securely fastened (e.g., sewn) to the bottom of the front surface 11 of the lower padding, thereby leaving three (3) open sides of the flap 20. In this embodiment, the bottom flap 20 has a shape that enables at least outer side portions 24 of the bottom flap 20 to wrap around to the back surface 12 of the lower padding 10 once the flap 20 is raised up over the lower extremities of the infant. Alternatively, rather than be attached to the back surface 12 of the padding 10, the bottom flap 20 may be attached to the perimeter lateral side surface 13 of the front 11 and/or portion(s) of the front surface 11 itself.

While not meant to limit the invention, the side portions 24 of the bottom flap 20 are shown in the drawings as having pieces of hook or loop fastening segments 28 securely fastened (e.g., sewn) to an interior surface thereof for making a hook and loop mating connection. In a preferred embodiment, these fastening segments are hook segments 28 that connect to any one or more of the following positions: to the loop-like fabric of the back surface 12, to pieces of loop mating material 16 on the back surface, to combinations of back surface 12 and pieces of loop mating material 16, to the perimeter side surface 13 of the front 11, to portions of the material of the front surface 11, to loop mating segments on one or both of the perimeter side surface 13 and/or front surface 11, or even any combination of the foregoing. Again, since the entire bottom surface 12 of the padding 10, and optionally the perimeter surface 13 and portions of the front surface 11, may act as a mating surface for these fastening segments 28, the flap 20 itself, through use of its fastening segments 28, may be attached, adjusted and readjusted to a plurality of different positions or locations on or across the infant positioning device 5. Also, the strips or pieces of loop mating material 16 may reside on either the back 12 or the front 11 of the pad 10 so that the flap 20 may be attached and reattached to any portion of the device 5.

In one or more embodiments, the bottom flap 20 may be securely attached on one side thereof to a lateral side of the lower padding 10. Alternatively it may be attached at both a bottom portion 22 and lateral side of the padding 10 so that the bottom flap's opposite side and top thereof remain unattached to the padding 10. In this aspect, this opposite side of the bottom flap 20 may have one or more components acting as hook or loop mating segments (e.g., one or more pieces of Velcro®, or even a single strip of Velcro®) for attachment to the opposite lateral side 13, backside 12 or portions of the front 11 of the present infant positioning device 5.

The bottom flap 20 may also be provided with one or more seams 29 that extend from the top portion 23 thereof. These seams 29 are sewn into the flap such that channels are formed between adjacent seams 29. Preferably, at least one middle seam is longer along the length of the flap to help bring the material in around the infant and generate more of a sack or womb-like environment. When an infant is placed in the supine position (i.e., on its back), the infant is positioned in a flexion and midline position with its arms in a bent-elbow, hands-up position towards its face and its hips, legs and feet in an up position as if the infant were still in the womb. The present flap 20 contributes to the womb-like environment of the present multipurpose infant positioning device 5 whereby the channels in the flap receive the infant's feet in a comfortable position, preferably without padding, to allow the infant to move and flex their feet as if in the womb. These channels also help to maintain the infants legs in this flexion and midline position, thereby preventing the undesired falling outward and flattening of the infant's legs and hips.

Another feature of the bottom flap 20 is that after the infant flexes or kicks its feet against the flap material, the elasticity of this stretchy flap material both contains the infant's feet, without restraining them, and provides resistance to entice the infants feet back to the flexion and midline position, just as if in the womb, which is desired for normal infant long term growth and development. Also, as the infant grows, the hook and loop mating connection of this bottom flap allows the flap to be loosened and reattached at any location on the device 5 for providing the infant with more room, or optionally even for tightening the bottom flap around the infant. This flap is also easily removable for gaining access to the infant (e.g., for changing a diaper) without substantially disrupting or disturbing the infant and without unfastening the wings 30, 32 (described further below).

The various embodiments of the present multipurpose infant positioning devices are also provided at least one wing 32 attached to a lateral side of the padding 10. This wing 32 is sufficiently long enough to be able to wrap around and secure the infant within the positioning device 5. The wing 32 also has an attachment component attached thereto acting as a hook or loop mating segment (e.g., one or more pieces of Velcro®), whereby the combination of the wing length and this attachment component allow the wing to be attached to the backside 12 or a hook/loop mating material 16 on the back surface, to combinations of back surface 12 and pieces of mating material 16, to the opposite perimeter lateral surface 13 of the front 11, to portions of the material of the front surface 11, to loop mating segments on one or both of the perimeter side surface 13 and/or front surface 11, or even any combination of the foregoing. In one or more preferred embodiments, the mating segment on the wing 32 may be a hook segment with the attaching surface of the back 12, mating material 16, lateral surface 13, front 11, or any combination thereof, being a loop mating material.

In one or more preferred embodiments the present infant positioning device is provided with a pair of wings 30 and 32 that may be of equal or unequal lengths. These wings 30 and 32 may extend from the same lateral side of the front surface 11 of lower padding 10, or preferably, the wings 30 and 32 extend from opposite lateral sides of the front surface 11 of lower padding 10. Each wing 30 and 32 also preferably has a sufficient width that enables the infant's arms to remain under these wings 30, 32 and within the positioning device 5.

The wings 30 and 32 are preferably of a material that does not harm or adversely affect the infant's skin. In a preferred embodiment, the fabric of wings 30 and 32 is an organic cotton material having a weaving pattern that enables stretching of the wings 30 and 32. In one or more embodiments, the wings may stretch in a number of different directions including horizontally, vertically, diagonally, and combinations thereof. For instance, the wings 30 and 32 may stretch substantially in the y-direction as shown in FIG. 1A. It is preferred that the wings 30 and 32 stretch in a direction, or directions, in a sufficient amount(s) that enables the wings 30 and 32 to contain the infant's shoulders, arms and hands, without restraining them, enabling the infant to move and flex its shoulders, arms and hands. Again, the elasticity of this stretchy material of the wings 30 and 32, particularly along the length of wing 32, also provides resistance during movement to entice the infant's shoulders, arms and hands back to the desired flexion and midline position.

In embodiments of the invention having a pair of wings 30, 32, the first wing 30 is fastened to a first side of the lower padding 10 and has a length that extends from this first side to the opposite side of the lower padding 10. Preferably, wing 30 does not extend beyond this opposite side of the lower padding 10. The fastened end of wing 30 is wider than its opposite end, and preferably is secured to the padding 10 in a location such that the top portion of this fastened end resides at least above an infant's armpit, preferably above the infant's arm and shoulder, when the infant is placed within the positioning device 5. This section of the wing 30 that is higher than the infant's armpit enables the wing 30 to round up the infant's adjacent arm and shoulder, which is desired for a flexed midline positioning once the infant is fully wrapped in the positioning device 5.

The second wing 32, which in one or more embodiments may be longer than the first wing 30, is preferably secured to the second, opposite side of the lower padding 10 for enhancing rounding-up of both the infant's arms and shoulders. The fastened end of wing 32 preferably has a width substantially equivalent to the fastened end width of wing 30, and is fastened to the second side of padding 10 at substantially an equivalent location so that the top portion of this second wing 32 also resides at least above the infant's opposite armpit, and preferably above the infant's arm and shoulder. Alternatively, the second wing 32 may be attached to the same side of the lower padding 10, whereby the wings are wrapped tightly enough around the infant to enable the desired rounding-up of the infant's arms and shoulders for the flexed midline positioning.

Again, the second wing 32 has a length that is sufficiently long enough to enable the distal end of the wing 32 to be attached to the back surface 12, mating material 16, lateral side surface 13, front surface 11, or any combination thereof, of padding 10 so that only the cotton material contacts the infant's delicate skin. In one or more preferred embodiments, the length of the wing 32 enables the wing to be wrapped around to the back surface 12 of the lower padding 10 to ensure that only the cotton material contacts the infant's delicate skin. It is undesirable to have any hook and loop mating connections contact the infant's skin, and as such, only the preferred organic cotton materials of the present multipurpose infant positioning devices 5 contact the infant's skin. Attached to an inner surface of the distal end of wing 32 is at least one fastening segment 38 for achieving the hook and loop connection between the fastening segment 38 and the fabric of the back surface 12, lateral side 13 and/or front surface 11 of the padding 10, such that, this second wing 32 may be attached and adjusted to any location on this material of padding 10. This is desirable since the wing 32 will be able to be easily adjusted to numerous sizes for accommodating a variety of sized infants, and even to accommodate for any stretching out of these wings. Wing 30 may optionally have a fastening segment at its distal end (not shown).

Figure 2A:
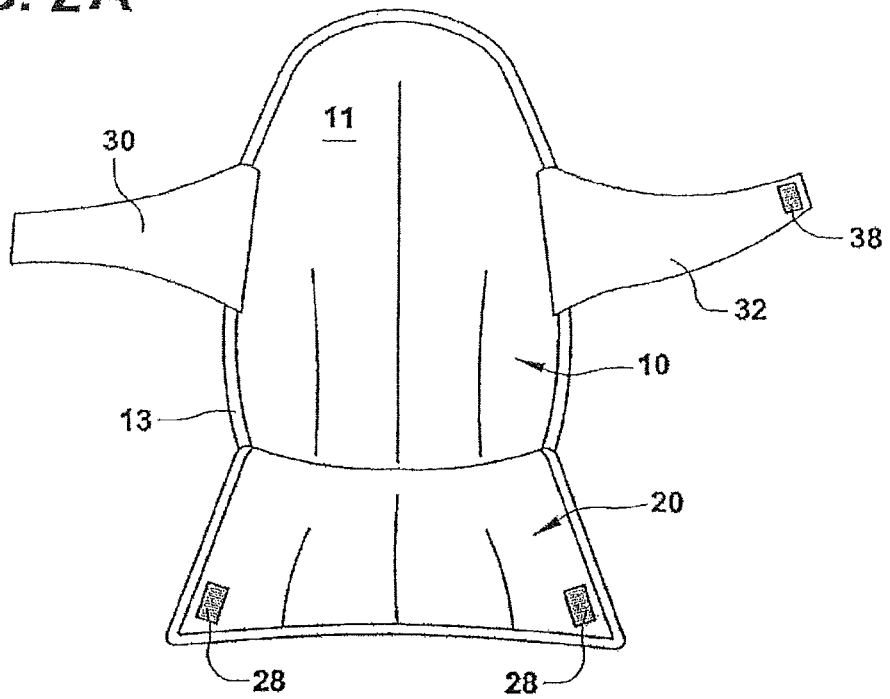
FIG. 2A-B are top down, front side views of other infant positioning devices in accordance with embodiments of the invention.
Figure 2B:
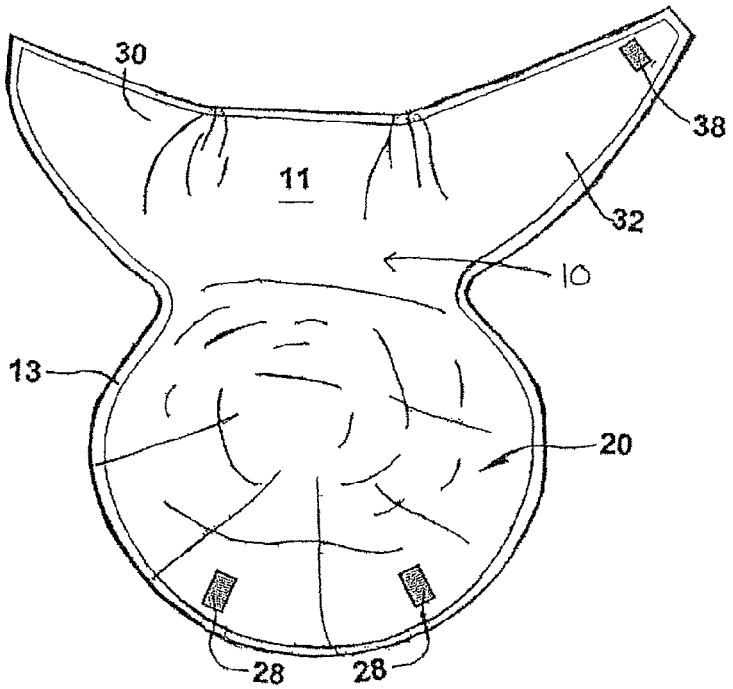

Referring to FIGS. 2A-B, one or more embodiments the present infant positioning devices 5 may be limited to including only the lower padding 10, the bottom flap 20, the pair of wings 30 and 32 and the various micro-fastening hook and loop segments, all of which are discussed in detail above. In this aspect of the invention, this type of infant positioning device would be beneficial once an infant has developed sufficient amounts of muscle flexion and tone, whereby the infant is able to partially maintain a flexed midline position on its own. By only including the lower padding 10 with the elasticity portions of the bottom flap 20 and wings 30 and 32, the infant is able to build sufficient additional muscle flexor and tone without the need for the additional components of the invention.

As shown in FIG. 2B, rather than the wings 30 and 32 and the bottom flap 20 being attached to the lower padding 10, the entire positioning aid may be of a single cut of fabric fabricated into the present multipurpose infant positioning devices 5. In so doing, a sheet of material or fabric is cut so that the lower padding 10, wings 30 and 32, and bottom flap 20 are provided in a one-piece structure.

In the embodiments shown in FIG. 2B, the location between the lower padding 10 and each wing 30, 32 is provided with a number of darts to help-wrap the wings 30, 32 under the infant's neck and around the shoulder girdle and help to keep the shoulders depressed. The wings 30 and 32 continue to support the shoulders in flexion, keeping them rounded and forward, and encouraging hand to mouth behaviors. That is, the wings 30 and 32 offer secure support while the stretchy fabric of the device 5 allows the infant to move, then return to midline. The microfasteners shown as the hook/loop sections 28 and 38 attached easily to the back surface (not shown) to provide a customized fit for supporting the infant's medical and developments needs. The bottom flap 20 is formed as a pouch to help round the hips, legs, and feet to a flexed, midline position, and the stretchiness thereof allows freedom of movement while providing proprioceptive feedback to the baby.

These embodiments of the invention shown in FIGS. 2A-B support the neurodevelopment of both preterm and/or ill infants, support back to sleep practice, and are beneficial in the implementation of kangaroo care transfer, IV starts, PICC line placement, diaper changes, visualization of specific areas without disturbing the baby, and the like. These embodiments of the invention also may be tightened for more secure support to encourage sleep and flexion, and loosened during active periods, all while providing the containment needed to help the infant maintain flexion. The upper and lower portions of the device may be adjusted independently of each other and may be individualized based on the infant's needs.

The one or more embodiments the present infant positioning device also help to facilitate a quality feeding by helping the infant stay organized and contained during gavage and oral feedings, help to maintain physiological flexion without restricting movement (due to the stretchiness of the device), and help to keep the infant's hands near the face to facilitate grasping and sucking behaviors. The devices also allow the infant to move freely into a comfortable position. From a caregiver's perspective, the one or more embodiments the present infant positioning device helps the caregiver to easily swaddle, handle and burp the infant without bulky blankets, observe the head and neck to visualize feeding, feel respirations through the lightweight fabric, maintain good trunk alignment, have access to the midsection for medically complicated infants, and read and respond to the infant's cues more easily. The adjustable swaddling tension also helps to calm irritable babies and allows more stable infants the freedom to move and normalize tone.

Figure 1C:
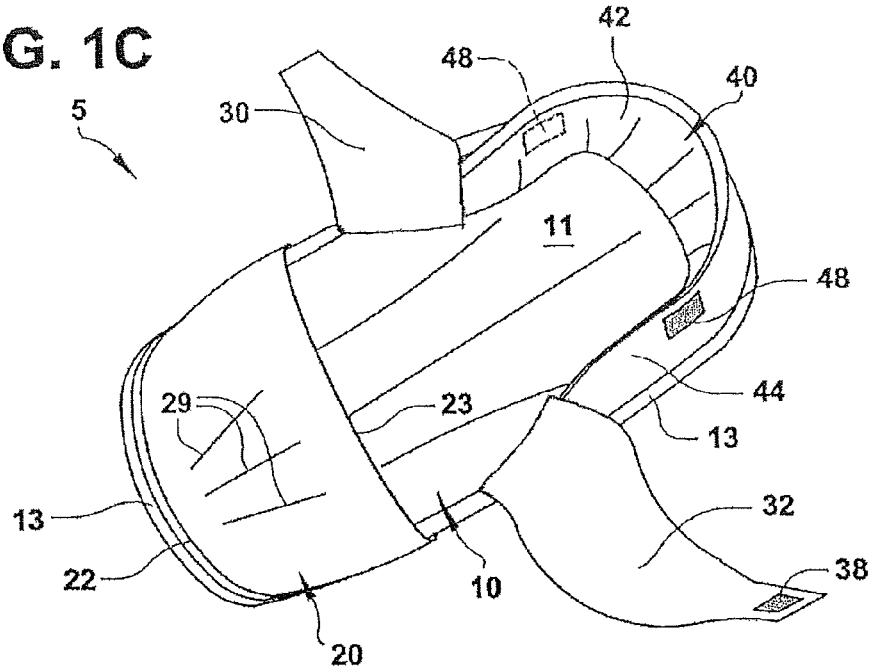
FIGS. 1C-D are side elevational views of the infant positioning device of FIG. 1A.
Figure 1D:
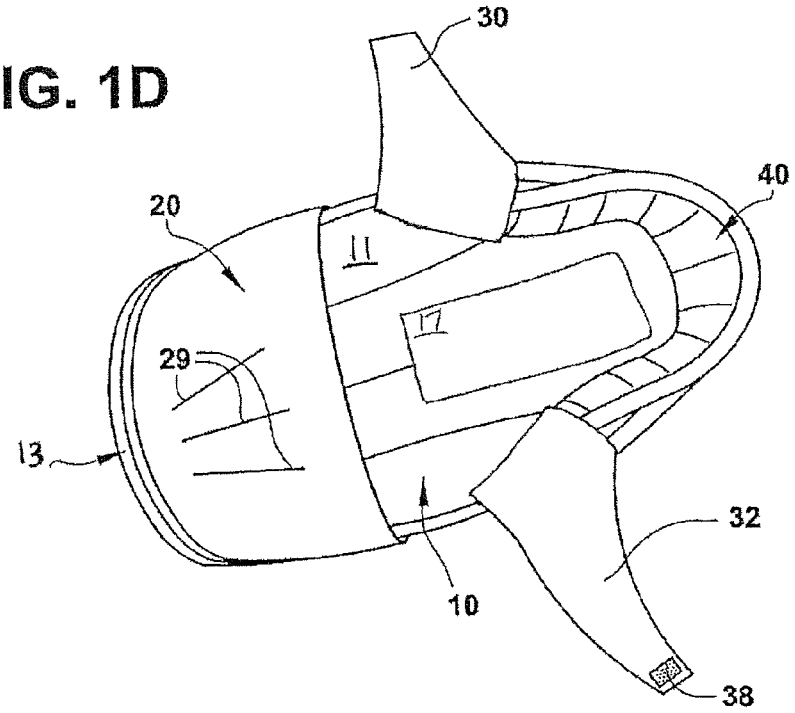

Referring to FIGS. 1C-D, in one or more embodiments the infant positioning devices include a headpiece 40 attached to the top portion of the lower padding 10. The headpiece 40 has upwardly extending walls that form a boundary for supporting an infant's head. Between the fabrics of the inner 42 and outer 44 surfaces, the headpiece 40 is filled with a material that holds up well to washing of the device, such as for example, an open cell foam material. Alternatively, a batting material may be used to fill the headpiece 40. The headpiece 40 is also optionally provided with interfacing to provide sturdiness to the headpiece, to provide a soft boundary for contact and support of the infant's head.

The headpiece 40 has an inner surface 42 preferably composed of a material that will not harm the infant's skin and an outer surface 44 composed of a material that acts as a mating surface for a hook and loop mating connection. Preferably, the inner surface 42 is composed of an organic cotton material and the outer surface 44 is composed of a brushed or napped tricot polyester blend acting as the loop mating segment of the hook and loop mating connection. Alternatively, pieces of loop mating segments (of a hook/loop assembly) may be attached to the outer surface 44 of the headpiece 40. Attached towards a top section on sides of opposing outer surfaces of the headpiece 40 are one or more fastening segments 48, which preferably act as hook mating segments of a hook and loop mating connection assembly.

In use, the headpiece 40 advantageously provides the infant with the required boundary support for continued development, while not constraining the infant's head. Since the headpiece 40 does not constrain the infant, the infant is able to move within the headpiece 40 to find a comforting position with minimal energy expenditure. The fastening segments 48 are attached (e.g. sewn) to the outer surface 44 to allow the headpiece 40 to be folded down toward the outside to a retracted position as is shown in FIG. 1D. This retracted position is essential when the infant requires medical equipment and/or tubing (e.g., feeding tubes 95 and ventilator ports 96, as shown in FIG. 5F) that would otherwise not rest over the non-folded sides of the headpiece 40 as shown in FIG. 1C. Again, since the entire outer surface 44 of the headpiece acts as the loop mating surface, or since pieces of loop mating segments may reside on the outer surface 44, the fastening segments 48 may be attached at any number of locations across this outer surface 44.

Figure 4A:
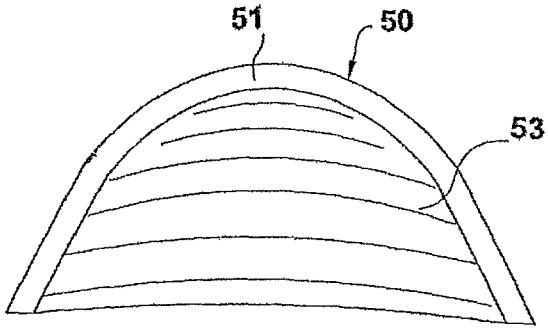
FIGS. 4A-B are top down, front side and back side views, respectively, of a brim of the various infant positioning devices of the invention.
Figure 4B:
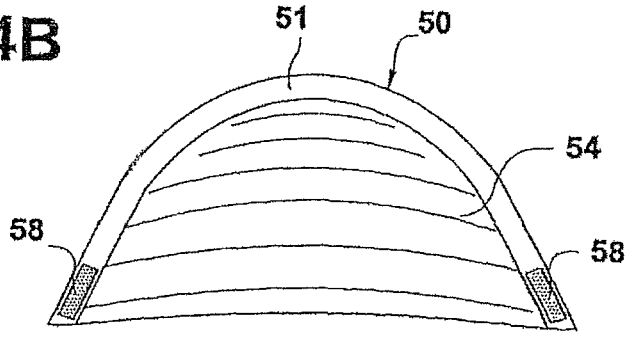

One or more embodiments of the present infant positioning devices also include a brim 50 as shown in FIGS. 4A-B. The brim 50 is composed of a double or single ply material that does not harm the infant's skin. The brim 50 has a shape that conforms to the top down view of the headpiece 40 so that once attached thereto, it is easily secured to the headpiece 40. The brim 50 may be provided with trim 51 on outer rims of both the front 53 and back 54 of the brim 50. The trim 51 is of a material that may act as a hook or loop mating segment of a hook and loop mating connection. Preferably, the brim is also provided with one or more fastening segments 58 on this trim 51 portion at the backside 54 of the brim. The brim may further include tacked stitching on a side thereof to provide a hinge that makes the brim easier to use. These stitches may be cut if a different brim orientation is required.

In use, the brim 50 may be attached to the headpiece 40 using the hinge and/or the hook and loop mating segments. For instance, the brim may be attached to the headpiece 40 such that the hook fastening segments 48 of the headpiece securely attach to the loop mating surface of the trim 51, and the one or more fastening segments 58 of the brim securely attach to the loop mating surface of the headpiece 40. These hook and loop mating connections of the brim to the headpiece may be used alone or in conjunction so that the brim may be positioned at several locations over the headpiece 40. Once attached, the brim 50 is spaced a distance above the infant's head and protects the infant's sensitive eyes from light exposure and acts as an acoustic shielding to protect the infant's sensitive hearing from loud noises.

Figure 3A:
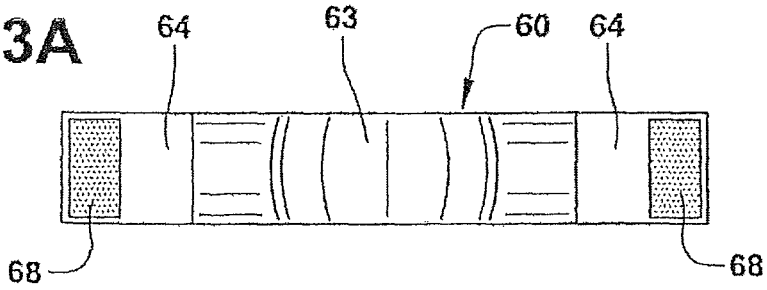
FIG. 3A is a top down, front side view of a positioning pillow of the various infant positioning devices of the invention.
Figure 3B:
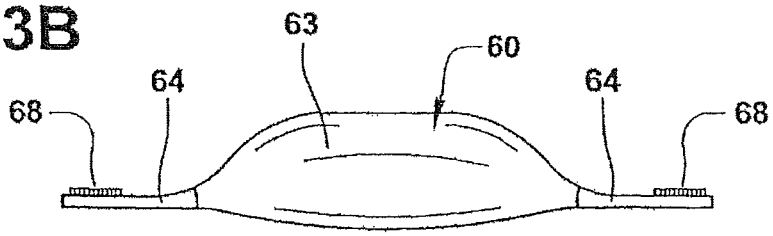
FIG. 3B is a side view of the positioning pillow of FIG. 3A.

One or more embodiments of the present infant positioning devices may further include a detachable multipurpose pillow 60, which is shown in FIGS. 3A-B. This multipurpose pillow 60 is composed of a material that does not harm the infant's skin, such as, an organic cotton material. The multipurpose pillow 60 has a middle portion thereof filled with batting to provide a cushioned midsection 63, and a pair of straps 64 extending from each side of the cushioned midsection 63. One or more fastening segments 68 are attached to each extending strap 64. Again, these fastening segments 68 are one component of a hook and loop mating connection, while the material at the back surface 12 of the lower padding 10 is the mating second component of such hook and loop connection. In a preferred embodiment, the fastening segments 68 act as the hook mating segment while the material at the back 12 of the lower padding 10 acts as the loop mating segment. In this manner, when the detachable multipurpose pillow 60 is attached to the lower padding for positioning an infant in the supine position, this multipurpose pillow 60 may be detached and adjusted to a plurality of different locations across the padding 10 and it may be securely attached at various locations at the back side 12, lateral side 13 and/or front surface 11 thereof.

One or more embodiments of the invention may further include a soft pillow 80 to help position the infant within the present infant positioning devices 5. This soft pillow 80 is preferably an elongated filled layer that provides cushioning for the infant. It may be filled with any soft, cushioning material suitable for use in infant care including, but not limited to, a gel, crushed rubber, z-flo, etc. In one or more preferred embodiments the soft pillow 80 is a soft gel pillow 80. The gel pillow may be pre-warmed to the infant's body temperature and maintained at ambient temperature of the incubator or radiant warmer.

Various embodiments of the present infant positioning aids may further be provided with phototherapy devices, whereby portions of the positioning aids 5 are composed of a 2-ounce organic cotton material that allows light transmission there-through such material. The phototherapy may be delivered by way of an overhead bank of lights or via a pad that contains phototherapy lights that goes under the infant. When the phototherapy is delivered by overhead lights, the wings 30, 32 and bottom pouch 20 are composed of a transmissive material (e.g., 2 oz. organic cotton) that allows light transmission there-through to reach the infant's skin. When the phototherapy lights comprises a pad, a pocket 17 (as shown in FIG. 1D) may be added to the top surface 11 of the lower pad 10 into which the phototherapy light pad is placed, whereby the infant is positioned on top of this pocket. The pocket is preferably composed of the lightweight material (e.g., 2 oz. organic cotton) that allows light transmission there-through to reach the infant's skin. Combinations of these phototherapy applications (i.e., the overhead light and light pad applications) also may be implemented in accordance with the invention.

In use, the multipurpose infant positioning devices of the various embodiments of the invention support a number of infant positioning techniques and are easily interchangeable therebetween. That is, unlike that of the prior art, the present invention provides a single device that supports multiple infant therapeutic positioning techniques, including, supine, prone and side lying positioning, and this single device allows easy transition between these various positions.

Referring to FIGS. 5A-F, the infant positioning devices of the invention support supine positioning of an infant provided therein. In an ideal supine position, the infant lies on its back in a flexion and midline position with its arms in a bent-elbow, hands-up position towards its face, and its hips and legs rounding in an upward position as if the infant were still in the womb. The present multipurpose infant positioning devices are a significant improvement over that of the prior art in that they support and maintain the infant in this supine position, and even entice the infant to move back to this supine position after movement of the infant. Is so doing, the present positioning devices help an infant to build muscle flexion and tone, both of which are necessary for normal infant development.

Figure 5A:
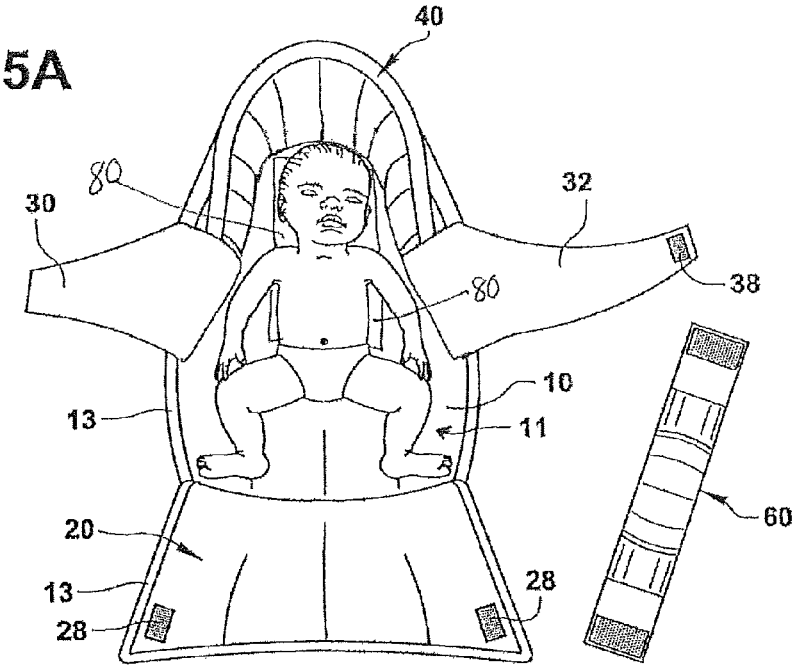
FIGS. 5A-F are top down views illustrating one embodiment of implementing the present infant positioning device for positioning an infant therein in the supine position.
Figure 5B:
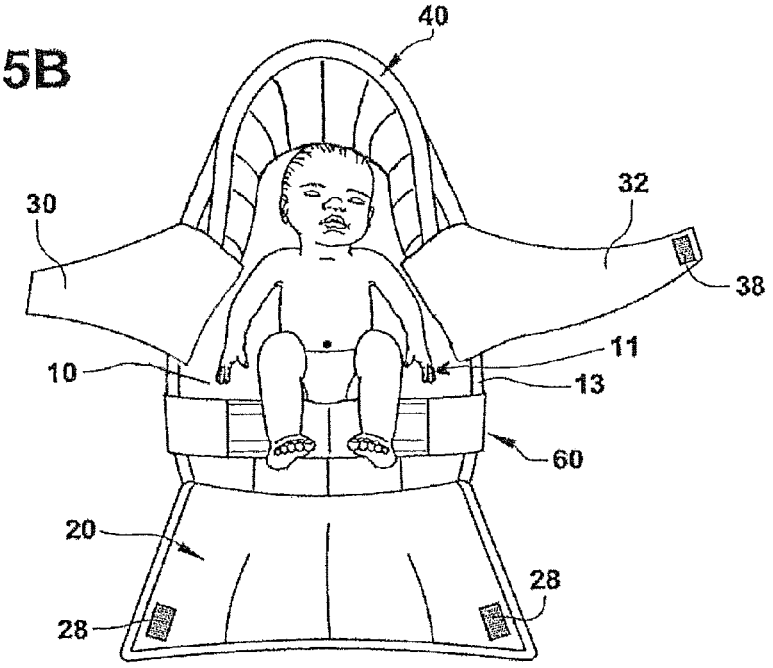
Figure 5C:
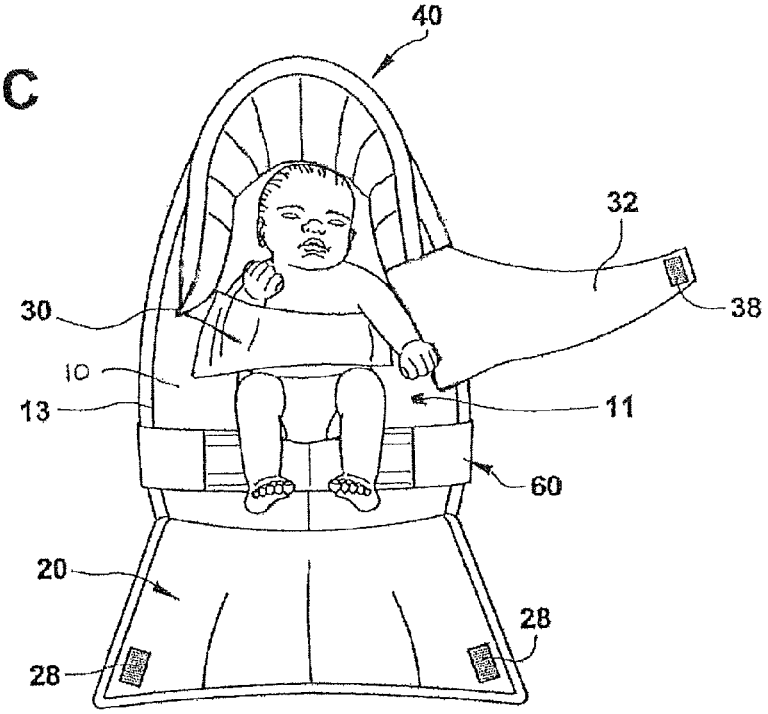
Figure 5D:
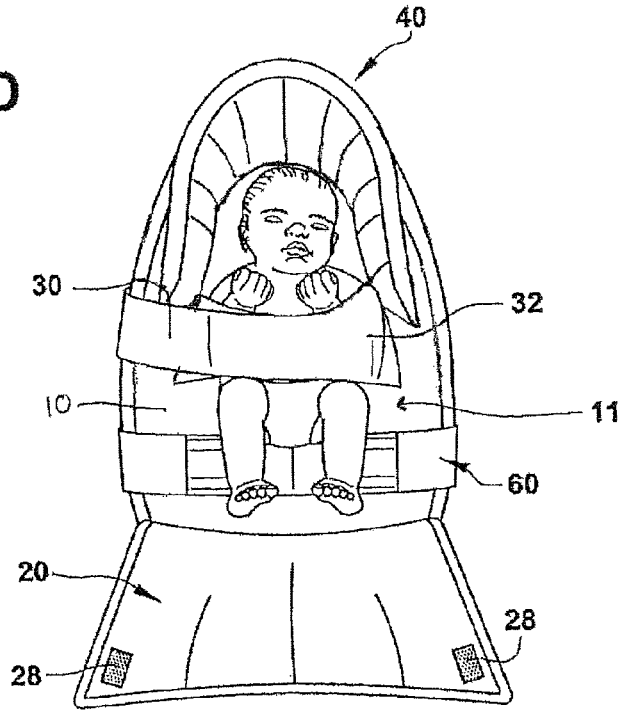

In the supine position, an infant is initially positioned with its back contacting the lower padding 10 of the present infant positioning devices, as shown in FIG. 5A. Optionally as shown in FIG. 5A the pre-warmed and covered soft gel pillow 80 may be provided inside the base so the top of the gel pillow touches the top of the head boundary, and then the infant is placed on the gel pillow with the infant's head nestled into the boundary.

Either the wings 30 and 32, or the multipurpose pillow 60, may then be utilized to position the infant. Preferably, the wings are first wrapped around the infant to secure the infant in a proper location within the positioning device, followed by securing the multipurpose pillow 60 under the hips and pelvis of the infant. In so doing, the top end of the smaller first wing 30 resides above the infant's adjacent armpit and is provided over the infant's arms, which are both preferably midline positioned with elbows bent upward and the hands toward the face, to round the shoulders forward and help bring the arms up and forward toward the infants face, thereby supporting shoulder flexion. That is, the infant's upper extremities are brought into midline flexion with head near face, and then the shorter wing 30 is pulled over the infant's arms rounding its shoulders forward. The distal end of the first wing 30 is then wrapped around the other side of the infant.

The second wing 32 is then securely wrapped over and on top of the first wing 30, as well as over the midline positioned arms to keep the shoulders rounded and contain the arms comfortably. The fastening segment 38 of this wing 32 securely attaches to the back surface 12 of padding 10.

This wing 32 may be secured to individualized locations to accommodate the infant's needs and medical conditions. Again, as the infant moves his arms, the elasticity of these wings provides resistance to entice the infant's arms and hands back to the desired midline position. Conventional positioning devices pull from only the side of the infant and do not offer this forward shoulder rolling from both sides to provide proper and adequate flexion as does the present invention. As an alternative embodiment, only a single second wing 32, which is adjustably positionable and repositionable to various locations on the device 5, may be used to secure the infant within this midline position.

The multipurpose pillow 60 is then positioned distal to the infant's buttocks, and optionally partially up and under the infant's hips and buttocks, to support the pelvis in the supine position by rounding out the hips, knees and legs in a flexed midline position with the infant's legs in an upward position toward its chest. The fastening segments 68 of the pillow wrap around to the back surface 12 of the padding 10 to secure the pillow 60 in position for maintaining this midline positioning.

Figure 5E:
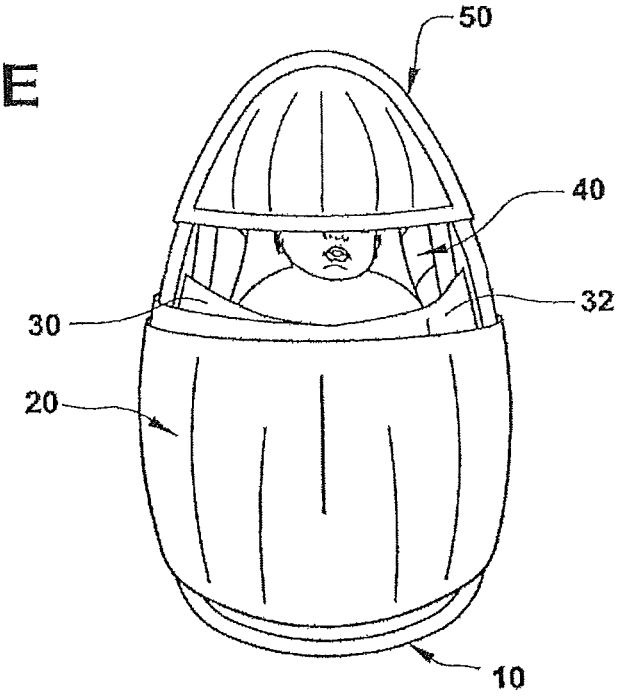
Figure 5F:
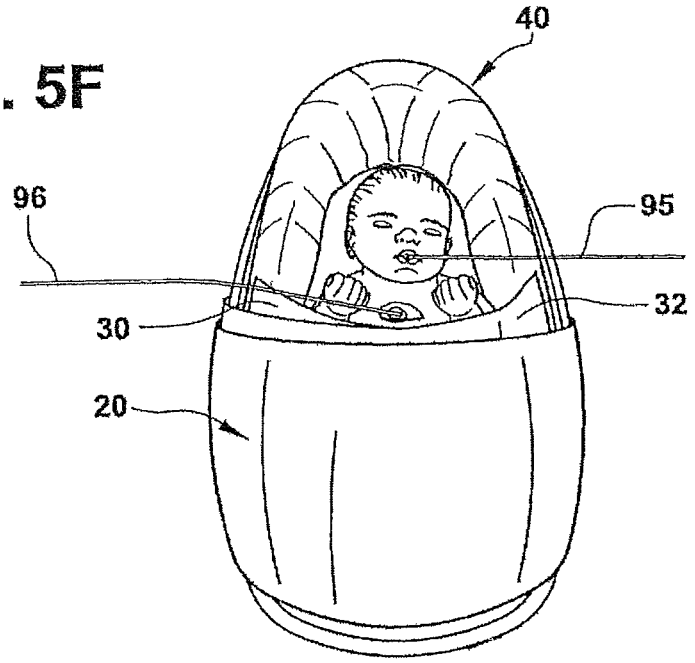

The bottom flap 20 is then brought up over the infant's legs and securely attached to the back surface 12 of the padding 10 using the hook segments 28 of such bottom flap. Again, this bottom flap 20 and the wings provide a womb-like environment for the infant. When the infant kicks against the bottom flap 20 the elasticity of this stretchy flap material (e.g., one-directional stretchy flap material) both contains the infant's feet and provides resistance to entice the infant's feet back to the flexion and midline position. If more visualization of the infant's midsection is needed, the bottom flap or pouch can be folded down and attached anywhere along the sides. Referring to FIGS. 5E-F, as discussed above, the brim 50 may be attached to the headpiece 40 and/or the headpiece 40 may be secured in a retracted position to enable tubing accessing to the infant. FIG. 5F also shows that the headpiece 40 may be secured down in a retracted position to accommodate and avoid interference with any medical equipment, such as, feeding tubes 95 and/or ventilator ports 96.

Figure 6A:
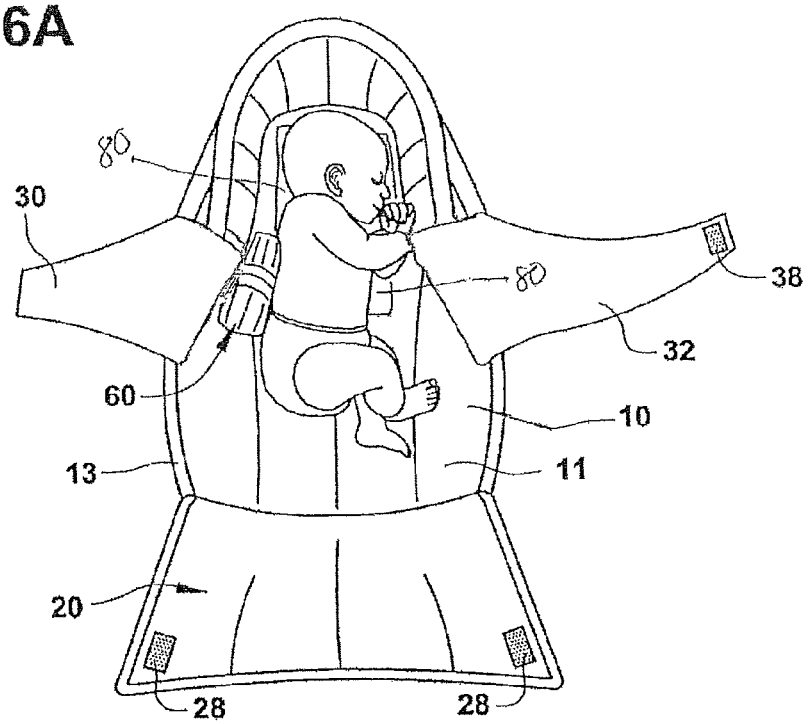
FIGS. 6A-B are top down views illustrating another embodiment of implementing the present infant positioning device for positioning an infant therein in the side-lying position.
Figure 6B:
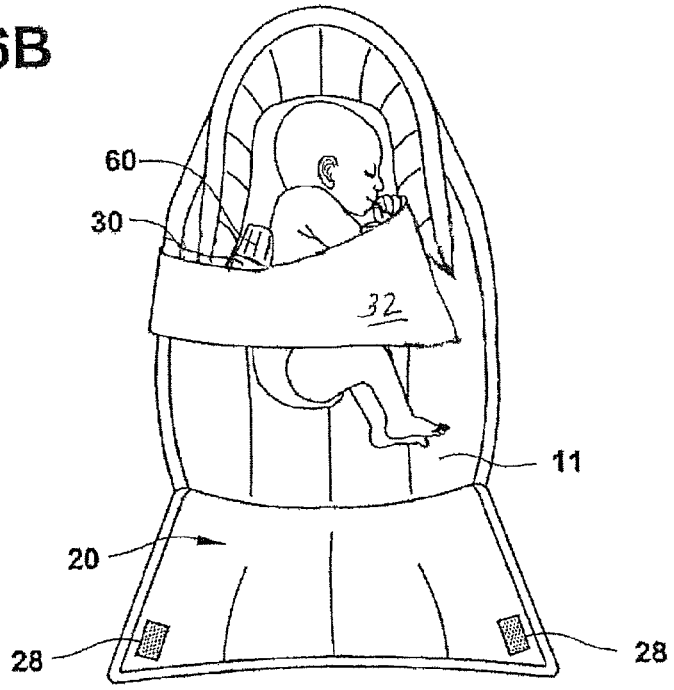
Figure 7A:
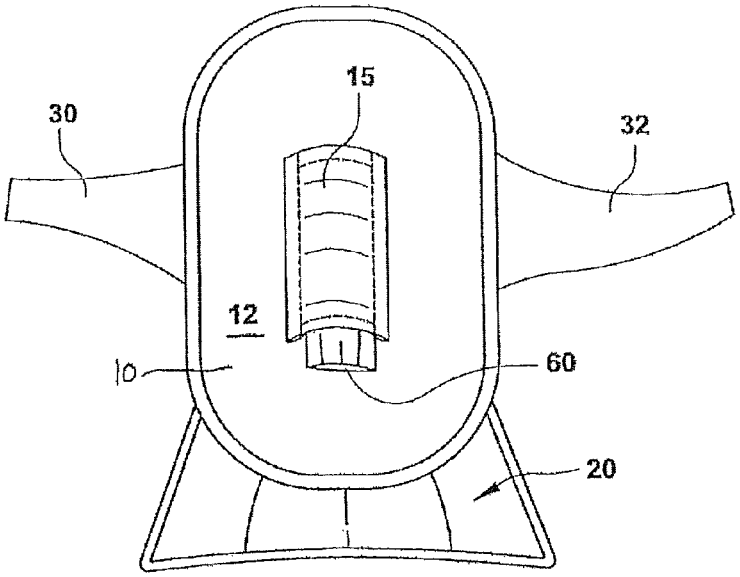
Figure 7B:
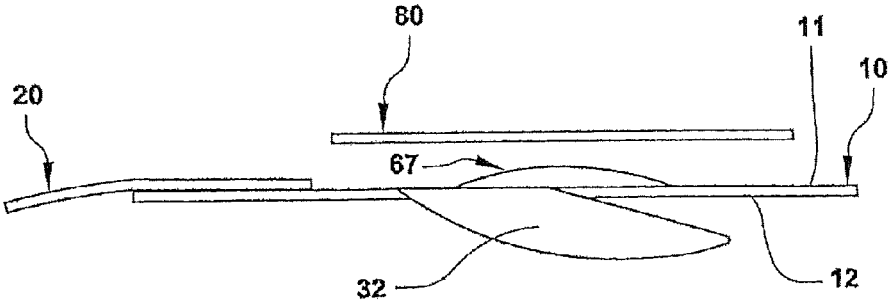

Referring to FIGS. 6A-B, the same infant positioning device, or another infant positioning device of the invention, also support side-lying positioning of the infant. Wherein the same infant positioning device is used, the infant can be moved from the supine position to the side-lying position (or vice-versa) without removing the infant from the positioning device.

In the side-lying approach, the infant may be placed on its side, or at least partially on its side, directly onto the lower padding 10, or optionally as shown in FIG. 6A the pre-warmed and covered soft gel pillow 80 may be provided inside the base with the top of the gel pillow touching the top of the head boundary. Once the infant is either on the padding or on the pillow 80, the infant is positioned in the flexed, midline position with its hands and arms up toward the face and its hips and legs up towards the belly. The first wing 30 is placed over the infant's side, or may be tucked away, and then the second longer wing 32 is wrapped around the infant's side and is attached to the back side 12 of the pad 10.

The multipurpose pillow 60 may be positioned behind the infant's back, or up under the infant's back so that the infant is lying partially on the pillow in a side-lying position. Alternatively, the multipurpose pillow 60 may be provided between the infant's legs to bring the hips into a neutral position, or as needed. In both positions, the fastening segments 68 of the pillow are preferably tucked away under the pillow so that they do not contact the infant's skin. The bottom flap 20 may be brought up over the infant's legs and secured to the back side 12 of padding 10. Optionally, the brim 50 may be attached to the headpiece 40 and/or the headpiece 40 may be secured in a retracted position to enable tubing accessing to the infant.

This same single infant positioning device, or another infant positioning device of the invention, may further be used for prone positioning of the infant. Referring to FIGS. 7A-D, the multipurpose pillow 60 is inserted into the pocket 15 at the back side 12 of the padding 10, and then the positioning device is flipped over to its front side. Prior to positioning the infant on the lower padding 10, the soft gel pillow 80 may optionally be provided over a top surface of the lower padding 10 to provide additional cushioning for the infant. The soft gel pillow 80 is preferably an elongated filled layer that at least covers and extends partially beyond the bump 67 at the center of the positioning device, whereby this bump 67 is formed by the multipurpose pillow 60 residing in the back side pocket 15.

In positioning the infant in the prone position, the infant is positioned on top of the pillow bump 67 from the belly button to the head so that the infant's hips and shoulders fall forward, thereby allowing the arms, hands, legs, knees, and feet to all roll forward and tuck under the infant to provide the necessary flexion and midline positioning. Again, the soft gel pillow 80 provides a soft resting place for the infant's elbows and knees. Once the infant is in the prone position, the wings may be wrapped around the infant as described above to secure and maintain the infant in this position, followed by securing the bottom flap over the infant.

The benefits of prone positioning using the present positioning devices with the multipurpose pillow 60 is that they facilitate shoulder rounding when the arms are at the sides, promote flexion without placing excessive pressure on the knees and elbows, support alignment of the head and trunk, facilitate hand-to-mouth coordination, and allow the infant's legs to remain tucked with the pelvis tilted forward. Some of the clinical benefits of prone positioning are that it encourages development of flexor tone, provides appropriate positioning on the stomach as an alternative to other positions to reduce skull flattening, allows active neck extension and enables head raising for muscle strengthening.

Accordingly, the present multipurpose infant positioning devices provide an infant with a womb-like environment to provide the infant with support, particularly, for those premature and/or ill infants that have little or no tone and/or flexion. The present positioning devices provide an infant with freedom of movement therein, while simultaneously providing the infant with resistance to entice the infant's feet, legs, knees, hips, arms and hands back into a flexed midline position, which is optimal for normal infant growth and development. Importantly, the infant may be repositioned between any two of the supine, side-lying an prone positions without removing the infant from the device and without substantially disturbing the infant.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An infant positioning device comprising:

a lower pad having a top portion, a bottom portion, and first and second lateral sides;

a first wing attached to the first lateral side of the lower pad, the first wing extending across a width of the lower pad and having resiliency along said length;

a second wing attached to the second lateral side of the lower pad, the second wing extending across the first wing, across the width of the lower pad and contacting a back portion of the lower pad;

a fastener attached to the second wing to attach the second wing to a plurality of different locations on the back portion of the lower pad; and a bottom flap of the lower pad, the bottom flap having a fastening segment that securely attaches the bottom flap to different locations on the back portion of the lower pad, the bottom flap having an enclosed bottom portion that forms a pouch to contain and enclose an infant's legs and feet therein.

2. The infant positioning device of claim 1 wherein the infant positioning device is a one-piece structure with the first and second wings and the bottom flap all comprising sections of the lower pad itself.

3. The infant positioning device of claim 1 wherein the first and second wings and the bottom flap are permanently attached to the lower pad.

4. The infant positioning device of claim 1 wherein the bottom flap of the lower pad has a plurality of channels formed between adjacent seams to form said pouch.

5. The infant positioning device of claim 1 wherein the plurality of different locations further reside on a front surface and a side of the lower pad.

6. The infant positioning device of claim 1 further including an upwardly extending headpiece affixed to a top portion of the lower pad that forms a supporting boundary for an infant's head.

7. The infant positioning device of claim 6 further including a brim for attaching to the headpiece, the brim covering a top of the headpiece to cover the infant's head.

8. The infant positioning device of claim 1 further including a detachable multipurpose pillow that is adjustably positioned to a number of locations on the infant positioning device to support an infant therein in different therapeutic infant positions.

9. A multipurpose infant positioning device comprising:

a lower pad;

a first wing of the lower pad;

a second wing of the lower pad, the second wing having a length long enough to extend across a width of the lower pad;

a fastener attached to the second wing to attach the second wing to a plurality of different locations on the lower pad;

a bottom flap of the lower pad, the bottom flap having a fastening segment to securely attach the bottom flap to different locations on the lower pad, the bottom flap having an enclosed bottom portion that forms a pouch to contain and enclose an infant's legs and feet therein;

a headpiece attached to and extending upward from the lower pad, the headpiece forming a supporting boundary that supports an infant's head; and a detachable pillow having a fastener attached thereto to adjustably attach the detachable pillow to the plurality of different locations on the lower pad.

10. The infant positioning device of claim 9 further including a detachable brim that is removably attachable to the headpiece.

11. The infant positioning device of claim 10 wherein the detachable brim has a shape conforming to a top down view of the headpiece.

12. The infant positioning device of claim 9 wherein the headpiece comprises a fill material residing between inner and outer upwardly extending sidewalls.

13. The infant positioning device of claim 9 wherein the detachable pillow resides on the lower pad to support an infant in different therapeutic infant positions selected from the group consisting of supine position, side-lying position and prone position.

14. The infant positioning device of claim 9 further including one or more fastening components attached to a surface of the headpiece to fold the headpiece to a retracted position.

15. A method of therapeutically positioning an infant comprising:

providing an infant positioning device adaptable to support an infant in a variety of different therapeutic infant positions, the infant positioning device at least including a lower pad, a wing at a lateral side of the lower pad, a fastener attached to the wing to attach the wing to a plurality of different locations on the lower pad, and a bottom flap of the lower pad, the bottom flap having a fastening segment that securely attaches the bottom flap to different locations on a back portion of the lower pad, the bottom flap having an enclosed bottom portion that forms a pouch to contain and enclose an infant's legs and feet therein;

positioning an infant on the lower pad of the infant positioning device in a desired therapeutic infant position;

wrapping the wing over the infant; and attaching the wing to one of the plurality of different locations on the lower pad to maintain the infant in the desired therapeutic infant position.

16. The method of claim 15 further including positioning the bottom flap over the infant's lower extremities and attaching the bottom flap to the different locations on the lower pad to maintain the infant in the desired therapeutic infant position.

17. The method of claim 15 wherein the infant positioning device further includes a second wing, whereby the second wing is wrapped around the infant followed by attaching the first wing over the infant to maintain the infant in a flexed midline position.

18. The method of claim 15 further including providing a detachable pillow positionable at various locations on the lower pad for aiding in maintaining the infant in the desired therapeutic infant position.

19. The method of claim 15 further including providing an upwardly extending headpiece attached to a top portion of the lower pad, the headpiece having upward extending sidewalls that provide a supporting boundary for an infant's head.

20. The method of claim 19 further including a removably attachable brim for attaching and detaching to the headpiece, the brim covering a top of the headpiece to cover the infant's head.

* * * * *